US006812807B2

(12) United States Patent
Ergene et al.

(10) Patent No.: US 6,812,807 B2
(45) Date of Patent: Nov. 2, 2004

(54) TRACKING FEED FOR MULTI-BAND OPERATION

(75) Inventors: Ahmet D. Ergene, Melbourne, FL (US); Michael Zarro, Melbourne Beach, FL (US)

(73) Assignee: Harris Corporation, Melbourne, FL (US)

( * ) Notice: Subject to any disclaimer, the term of this patent is extended or adjusted under 35 U.S.C. 154(b) by 16 days.

(21) Appl. No.: 10/158,924

(22) Filed: Jun. 3, 2002

(65) Prior Publication Data

US 2003/0222733 A1 Dec. 4, 2003

(51) Int. Cl.[7] ..... H01P 5/12
(52) U.S. Cl. ..... 333/125; 333/21 A
(58) Field of Search ..... 333/21 A, 137, 333/117, 125, 135, 21 V; 343/895, 818, 708, 786, 755, 772, 78 R, 729, 776, 781, 784

(56) References Cited

U.S. PATENT DOCUMENTS 3,566,309 A * 2/1971 Ajiko ..... 333/135
4,258,366 A * 3/1981 Frosch et al. ..... 343/786
4,420,756 A * 12/1983 Hamada et al. ..... 342/153
4,821,046 A * 4/1989 Wilkes ..... 343/786
4,847,574 A * 7/1989 Gauthier et al. ..... 333/21 A
5,274,839 A * 12/1993 Kularajah et al. ..... 455/12.1
5,614,874 A * 3/1997 McCandless ..... 333/125
5,736,907 A * 4/1998 Chen et al. ..... 333/113
5,870,060 A * 2/1999 Chen et al. ..... 343/761
6,566,976 B2 * 5/2003 Krishmar-Junker et al. 333/125

* cited by examiner

*Primary Examiner*—Michael Tokar
*Assistant Examiner*—Linh V Nguyen
(74) *Attorney, Agent, or Firm*—Duane Morris LLP

(57) ABSTRACT

An antenna feed system comprises a single horn having corrugations and four evenly spaced waveguide ports on sides of a single one of the corrugations. A combiner network receives signals at approximately 20 GHz from the four waveguide ports and outputs sum and difference output signals. A transducer provides transmit signals at approximately 30 GHz and approximately 44 GHz to a rear end of the single horn.

26 Claims, 17 Drawing Sheets

TRACKING FEED FOR MULTI-BAND OPERATION

The U.S. Government has a paid-up license in this invention and the right in limited circumstances to require the patent owner to license others on reasonable terms as provided for by the terms of contract No. N00039-01-9-4007 awarded by SPAWAR.

BACKGROUND OF THE INVENTION

Satellite communication terminals require a subsystem to track the satellites with which they communicate. This requirement exists even with stationary ground terminals and geo-stationary satellites. While tracking provides an uninterrupted link throughout a lengthy operation, it also helps in initial acquisition of the satellite.

Most existing systems either use difference patterns or step-track on the main beam. Antennas on dynamic platforms (air-borne or naval) require a faster response tracking. Sequential lobing and nutating feeds are other forms of tracking on the main beam with a higher error slope at the expense of beam offset loss. All of these "tracking on the main sum beam" schemes, also commonly called "conscan", become extremely inefficient in multiband antennas when tracking is done on the broader receive pattern while the narrower transmit pattern steers away from the satellite suffering an extreme pointing loss.

The difference patterns provide an error-slope for a most accurate tracking scheme with a quick response. The difference patterns in turn can either be used in a monopulse system or a pseudo-monopulse system.

When covered with one broadband device, the transmit and receive frequencies encompass a one very wide band. In the commercial C-band and Ku-bands and the military Ka-Band this bandwidth is 40% with a ratio of ⅔ between the Receive and transmit bands. In the military X-band this total receive and transmit bandwidth is relatively narrower at 12%, and in the EHF (K- and Q-bands) it is relatively wider at 81%.

When designing an antenna system that operates simultaneously over multiple bands (i.e. X- and Ka-bands), each with its separate receive and transmit bands, there may be a requirement for a composite feed with separate waveguide parts for each band nested coaxially. Conventional one waveguide port horn systems do not satisfy this requirement.

It is desirable to nest the feeds for the different bands. Except for the innermost feed, which has the smallest size waveguide operating at the highest frequency band, conventional feeds do not solve this problem. The hollowed-out outer aperture of the feed operating at the lower frequency bands requires adaptations in the designs for the orthomode transducers (OMTs), polarizers and horns. In such a nested feed, all beams are pointed at the same satellite, so it is sufficient to track in any one band at any one frequency.

In the multi-band system where the feeds are not co-located but the aperture is partitioned into real and virtual focal points in a dual reflector system by a frequency selective surface (FSS), a pointing error may emerge between the two feeds. When one of the bands is at a much higher frequency, it may be mandatory to track at the higher frequency band and rely on the broader beam of the lower frequency, so as not to suffer a pointing loss. (i.e. X- and Ka-bands)

As the frequency of the band of operation gets higher and higher in the fixed size reflector systems, the antenna beam becomes excessively narrow, and tracking stability and speed become issues with tracking on the main beam. Such is the case in evolving Ka-band and Q-Band terminals.

When a combination of receive and transmit bands are too widely separated and have to be covered separately, a dual feed system is required. This is typically the case with the EHF (K-and Q-bands). The problem is exacerbated if space is limited, and the feed has to be made compact and cannot be separated into multiple feeds employing frequency selective partitions nor partitioned into clusters.

Even in the single band of operation, some small terminals with low f/d ratios, such as ring-focus antennas, a very compact feed may be required.

Systems capable of operating over multiple bands are desirable. Known systems includes feeds or feed systems that cover widely separated bands of operation, typically in (a) multiple feed systems with frequency selective surfaces and co-located/coaxial feeds with multiple ports for multiple bands, or in (b) dual-band corrugated horns pushing the limits.

The first scheme cannot be used in compact reflector systems with small apertures and small f/d ratios because of complexity and size of waveguide runs. Most ring focus reflector systems can not employ this scheme.

In the second scheme, it is known to use nested coaxial multi-band feeds. For example, the Lincoln Labs dual band EHF feed receives in the 20 GHz K-band and transmit in the 44 GHz Q-band; and the commercial Austin Info. Sys. multi-band feed receives at 20 GHz and transmits at 44 GHz.

It is accordingly an object of the present invention to obviate many of the deficiencies of known systems and to provide a novel method and tracking feed system with multi-band operation.

This and many other objects and advantages will be readily apparent to one of skill in this art from the following detailed descriptions of referred embodiments when read in conjunction with the appended drawings.

DETAILED DESCRIPTION OF PREFERRED EMBODIMENTS

Figure 1:
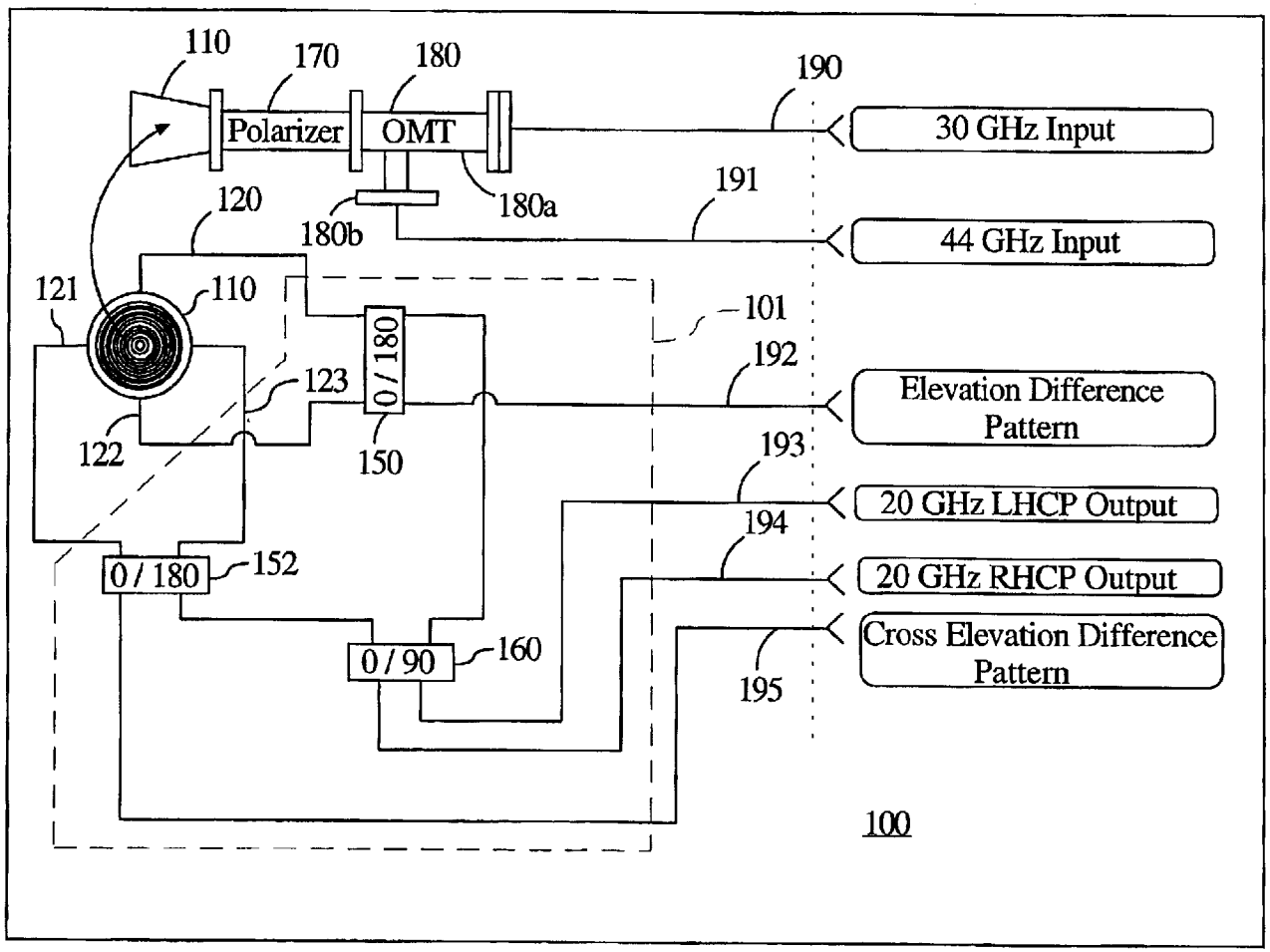
FIG. 1 is functional block diagram showing the receive and transmit feed system components for an exemplary embodiment of the present invention.

FIG. 1 is a functional block diagram of an exemplary antenna feed system 100 having a downlink feed subsystem and a transmit feed subsystem which share the single feed horn 110. The single horn 110 has a plurality of waveguide ports 120–123 coupled to sides thereof. A transducer (which may be an orthomode transducer, or OMT, 180) provides first and second transmit signals at input terminals 190 and 191 to the rear end of the single horn 110 by way of a broadband polarizer 170.

The polarizer 170 converts the linear input signals to circular polarization. The first and second transmit signals 190 and 191 may have respectively different first and second frequencies. A combiner network 101 receives signals from the waveguide ports 120–123 of the single horn 110 in a third frequency different from either of the first and second frequencies. The combiner network 101 provides sum output signals 193, 194 and difference output signals 192, 195.

The single horn 110 of system 100 has corrugations (shown in FIG. 5) and four evenly spaced wave guide ports 120–123 on a single one of the corrugations. The combiner network 101 (shown in detail in FIG. 6A) receives signals at approximately 20 GHz from the four waveguide ports 120–123 and provides a sum output signal 194.

The exemplary downlink signals may be between about 20.2 GHz and about 21.2 GHz, and the output signals 193, 194 are suitable for tracking and communications. The OMT 180 provides transmit signals at approximately 30 GHz and approximately 44 GHz to the rear end of the single horn110. More specifically, the exemplary transmit signals may range from about 30.0 GHz to 31.0 GHz, and from about 43.5 GHz to about 45.5 GHz, respectively.

As shown in FIG. 1, the combiner network 101 includes a first 0/180 degree hybrid coupler 150 and a second 0/180 degree hybrid coupler 152. The four evenly spaced wave guide ports 120–123 provide signals to the network 101. The first 0/180 hybrid coupler 150 is coupled to waveguide ports 120 and 122, and provides an elevation difference output signal on port 192. The second 0/180 degree hybrid coupler is coupled to waveguide ports 121 and 123 and provides an azimuth (or cross-elevation) difference output signal 195. The azimuth signal 195 and elevation signal 192 are suitable for tracking.

A third 0/180 degree hybrid coupler 154 (shown in FIG. 6A) has input terminals 192, 195 coupled to sum (Σ) outputs of the first and second 0/180 degree hybrid couplers 150 and 152. The third 0/180 degree hybrid coupler 164 provides the difference output signal for tracking.

A 0/90 degree hybrid coupler 160 has input terminals coupled to difference (Δ) outputs of the first and second 0/180 degree hybrid couplers 150 and 152. The 0/90 degree hybrid coupler 160 provides the sum output signal for communications, with both left hand polarization 193 and right hand polarization 194 simultaneously.

The four ports 120–123 provide signals having different phases. Relative to port 120, port 121 is 90 degrees lagging in phase, port 122 is 180 degrees lagging in phase, and port 123 is 270 degrees lagging in phase. Thus, the field is rotated to produce a corkscrew-type signal propagation from the horn.

Depending on which port 120–123 of the 0/90 degree hybrid coupler 160 is fed, the corkscrew-rotation of the signal may be clockwise or counterclockwise. Since the signals at the pairs of output ports (120, 122) and (121, 123) are 180 degrees out of phase with each other, a null in the sum output signal is produced. Thus, the use of the four ports 120–123 allows left and right hand signed output signals 193, 194 along with simultaneous elevation difference patterns 192 and cross-elevation (azimuth) difference patterns 195.

With continued reference to FIG. 1, the OMT 180 may have both right and left hand input ports 180*a* and 180*b*. In the configuration shown in FIG. 1, one of the 30 and 44 GHz input signals is given a left hand polarization by OMT 180, and the other of the two signals is given a right hand polarization. Thus, the configuration shown in FIG. 1 is desirable in a system in which the 30 and 44 GHz input signals are to be given orthogonal polarizations in OMT 180. Using this system, the two transmit frequencies may be used simultaneously with orthogonal polarizations.

Alternatively, two signals having the same frequency and orthogonal polarizations may be transmitted through OMT 180. This allows frequency reuse. Because of the different polarizations, two different transmit signals having the same frequency can be transmitted simultaneously without crosstalk.

Because the output ports of the 0/90 degree hybrid coupler 160 are coupled to receive the LHCP output signal 193 and the RHCP output signal 194 simultaneously, the system is suitable for "frequency reuse." That is, two different downlink signals 193 and 194 of the same frequency but having left and right hand polarizations, respectively, can be processed simultaneously without any crosstalk. The polarization diversity allows (but does not require) two downlink signals to be processed simultaneously. By way of example, this flexible system can be used for two downlink signals from one satellite, or one downlink signal from each of two satellites.

Figure 4:
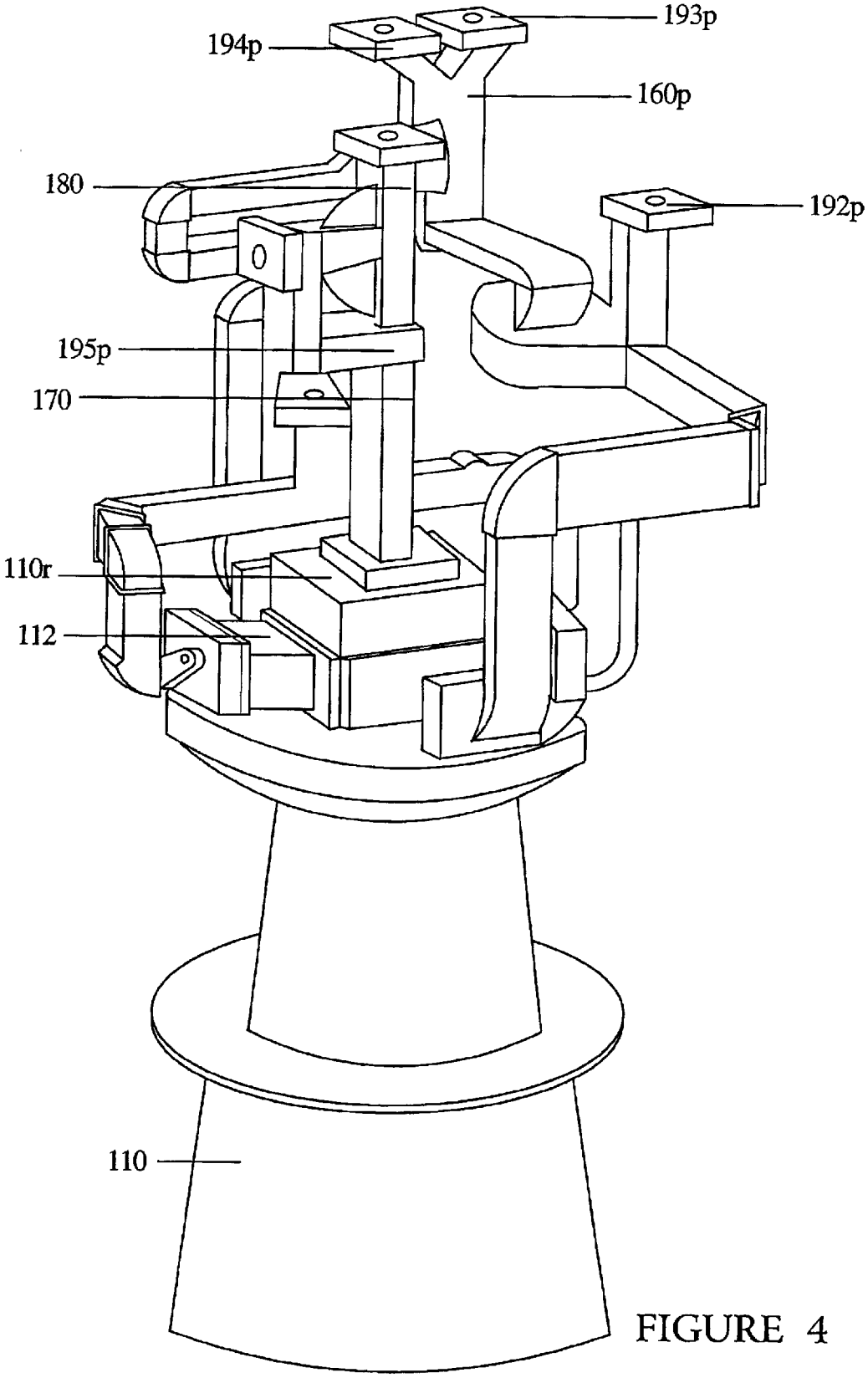
FIG. 4 is a pictorial representation of the components of FIG. 1.

FIG. 4 shows the single horn 110 in the feed system, with an input 110*r* at its rear. The OMT 180 provides the 30 GHz and 40 GHz signals to the polarizer 170, which in turn feeds the signals to the rear 110*r* of horn 110. In addition, four waveguides 112 are fed from the sides of the horn 110. These are the 20 GHz downlink ports of the horn. The elevation difference output port 192*p*, azimuth difference output port 195*p*, the communications LHCP output port 193*p* and RHCP output port 194*p* are also provided.

Figure 5:
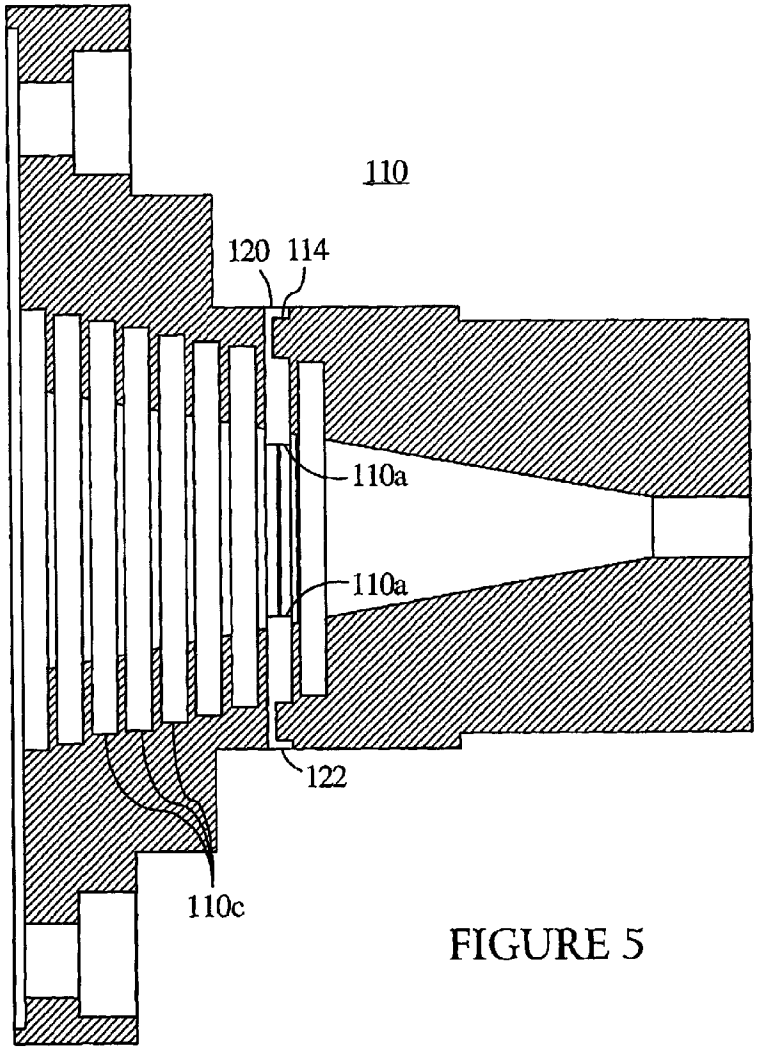
FIG. 5 is a pictorial view in cross-sectional of the horn of FIG. 4.

As shown in the cross sectional view of the horn in FIG. 5, the horn 110 has a plurality of corrugations 110*c*. Corrugated tracking feed horns are well known, and are described, e.g., in Patel, P. D., "Inexpensive multi-Mode Satellite Tracking Feed Antenna," IEE Proceedings, Vol. 135, Pt. H, No. 6, pp. 381–386, December 1988.

The single horn 110 has a respective opening 110*a* for each of the waveguide ports 120–123, with each opening formed by cutting a slot in one of the corrugations 110*c*. The system has a respective matching transformer 114 at each of the four waveguide ports. Appropriate 30 and 44 GHz mode filters are provided so that the only the 20 GHz signal sees the openings 110*a*.

The wave guide ports include a first pair 120 and 122, and a second pair 121 and 123. The ports of each pair are positioned 180 degrees apart. Each one of the 0/180 degree hybrid couplers 150, 152 is connected to a one of the pairs of waveguide ports 120–123.

The formation of the openings in the second corrugation 110*c* from the right is exemplary only. One of ordinary skill in the art can readily determine the appropriate corrugation into which the slots should be made for connecting waveguides to any particular feed horn, based on the size and angle of the horn. This can be accomplished using known scaling, tuning and optimization techniques to determine the corrugation that can be used so as to suppress all other lower or higher order modes which would obscure the difference pattern null and create excessive cross polarized components in the sum pattern. Thus, the appropriate corrugation for the launching of the signals, for a given horn design, may be the third, fourth, fifth, sixth, etc., corrugation dependent on horn diameter and flair angle.

Figure 8:
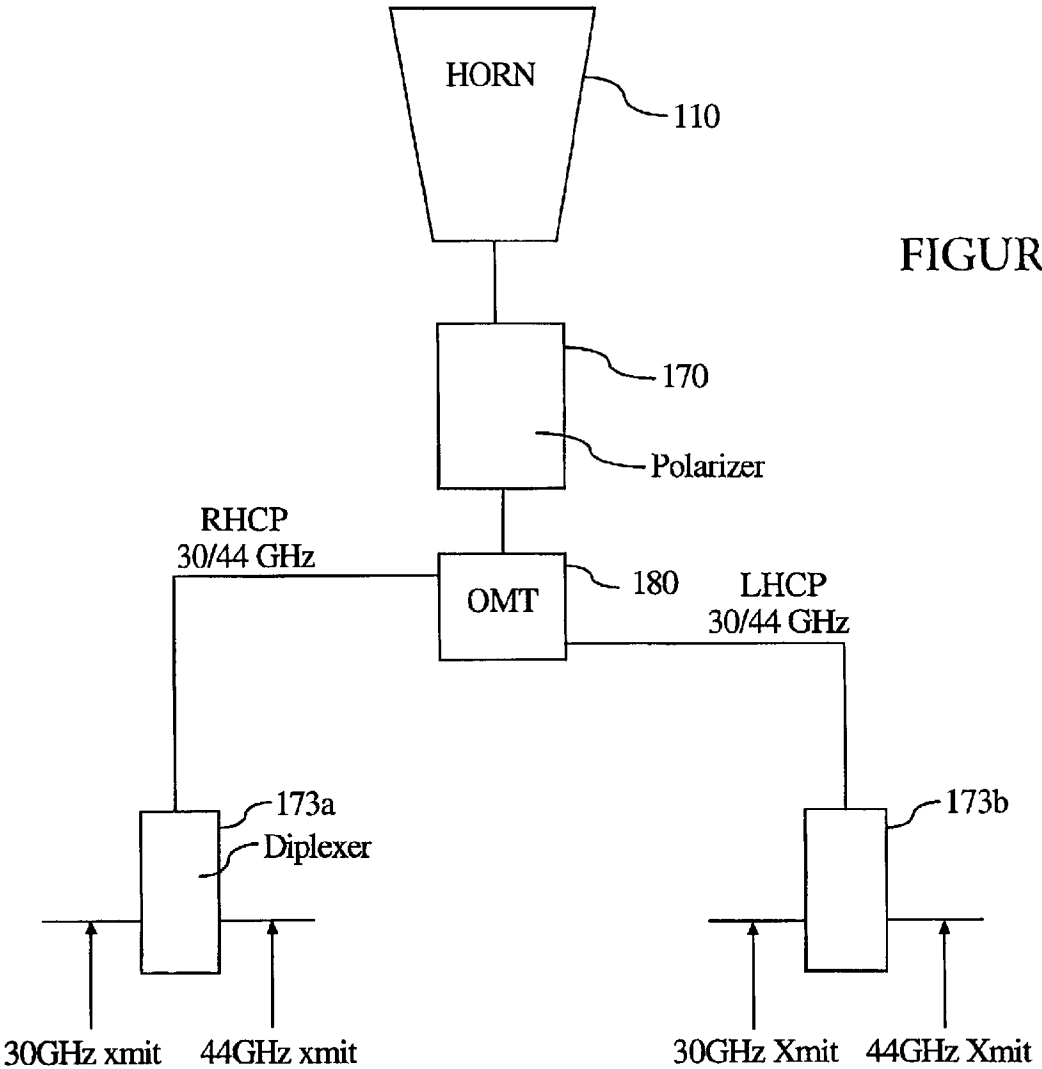
FIG. 8 is a block diagram of the feed of FIG. 1, configured to simultaneously transmit four signals.

FIG. 8 is a block diagram showing another use for a variation of the feed system 100 of FIG. 1. In this variation there are two separate 30 GHz transmitters and two separate 44 GHz transmitters, for a total of four transmitters. Two 30/44 GHz diplexers 173*a*, 173*b* are used to simultaneously provide the 30 GHz transmit signal 190 and the 44 GHz transmit signal 191 to both the right and left hand ports 180*a*, 180*b* of the OMT 180. It is thus possible to transmit four signals simultaneously, having four different combinations of frequency and polarization. One of ordinary skill in the art can readily construct a 30/44 GHz diplexer using known design techniques. The frequency reuse feed allows, at either and both frequencies, (a) simultaneous transmission at two orthogonal polarizations and/or (b) switchable transmission at two orthogonal polarizations. Note that the common feed structure comprising the OMT 180, the polarizer 170 and the horn 110 can be used for this application or other applications described below.

Figure 2:
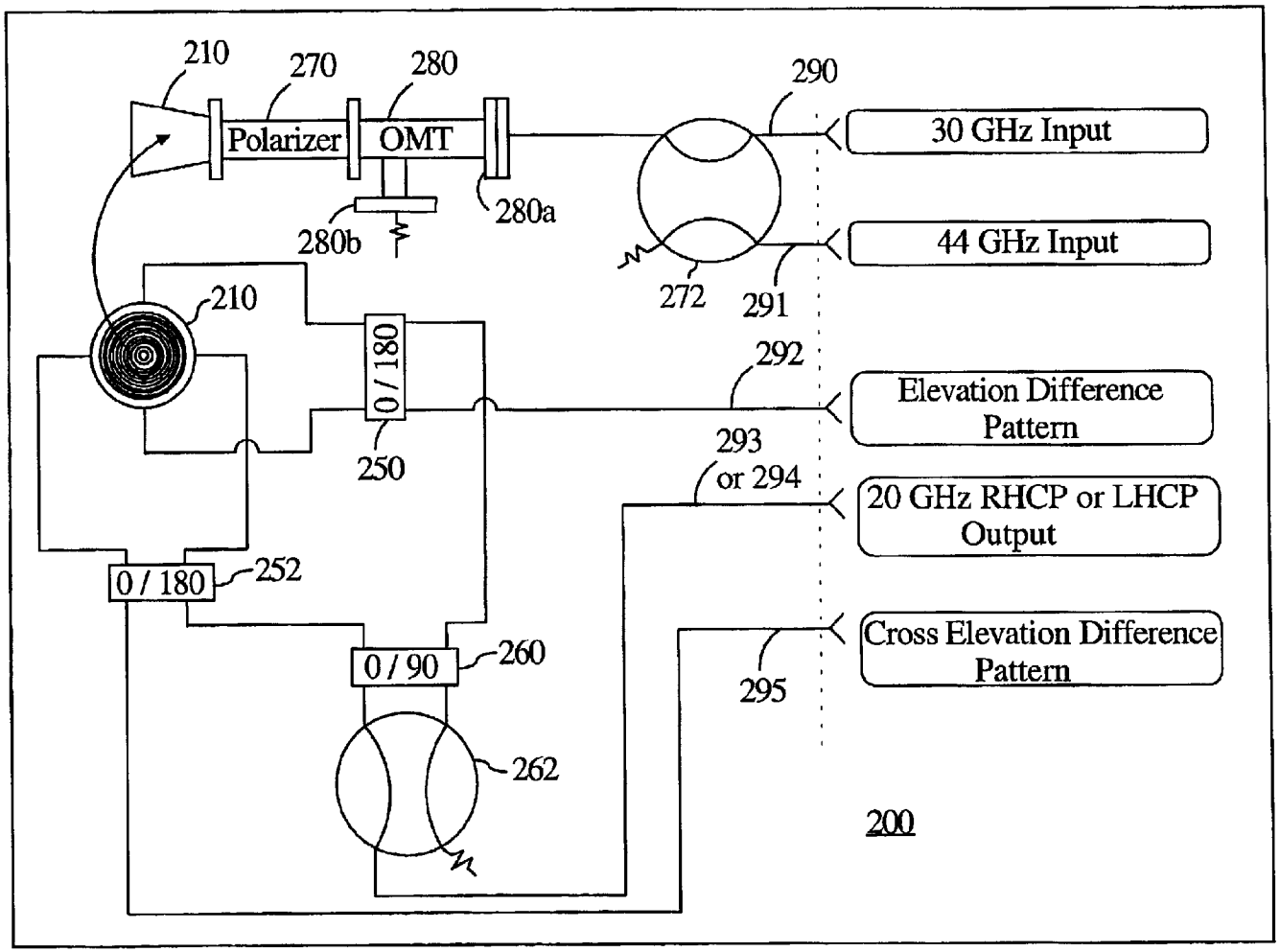
FIG. 2 is a block diagram showing the receive and transmit feed system components of a variation of the system of FIG. 1.

In FIG. 2, the elements that are the same as elements of FIG. 1 have the same two least significant digits. These include horn 210, 0/180 degree hybrid couplers 250, 252, 0/90 degree hybrid coupler 260, polarizer 270, transducer 180, 30 GHz input signal 290, 44 GHz input signal 291, elevation difference signal 292, 20 GHz LHCP output signal 293, 20 GHz LHCP output signal 294, and cross elevation difference signal 295. The descriptions of these elements will not be repeated. In the description of the other figures which follows, either reference numeral may be used.

In addition to the common elements, the transmit feed of FIG. 2 includes a switch 272 (which may be a transfer switch, also referred to as a "baseball" switch), which allows either of the two transmit input signals (e.g., 30 GHz and 44 GHz) to be provided to the same input port 280*a* of the OMT 280 by way of switch 272. At any given time, one of the input signals 290, 291 is provided to the OMT port 280*a*, and the other OMT port 280*b* is terminated. As a result, both of the transmit signals can have the same polarization. Both transmit signals can have right hand polarization, or both can have left hand polarization.

A second baseball switch 262 is provided at the outputs of the 0/90 degree hybrid coupler 260 and allows selection of either the left hand polarization output signal 293 or right hand polarization output signal 294 to be provided at the 20 GHz sum output port to control the polarization of the sum signal. In the case of a single satellite providing two downlink signals with orthogonal polarizations, this switch 262 allows selection of either polarization.

Figure 9:
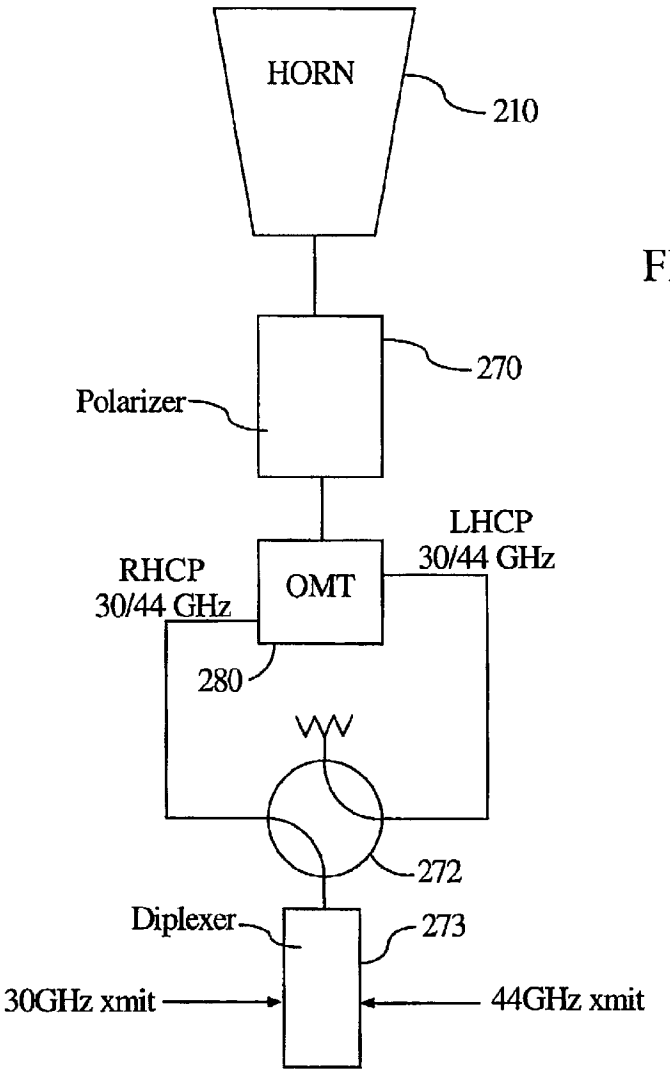
FIG. 9 is a block diagram of the feed of FIG. 2, configured to simultaneously transmit two signals with different frequencies using the same polarization.

FIG. 9 is a block diagram showing yet another use for the feed (including OMT 280, polarizer 270 and horn 210), with selective (switchable) use of different polarizations and different frequencies. The diplexer 273 provides both the 30 and 44 GHz signals to the switch 272, which in turn provides both frequencies to either the RHCP port of the OMT or the LHCP port. Thus, the addition of the diplexer 273 makes it possible to have signals with two different transmit frequencies and the same polarization.

Figure 3:
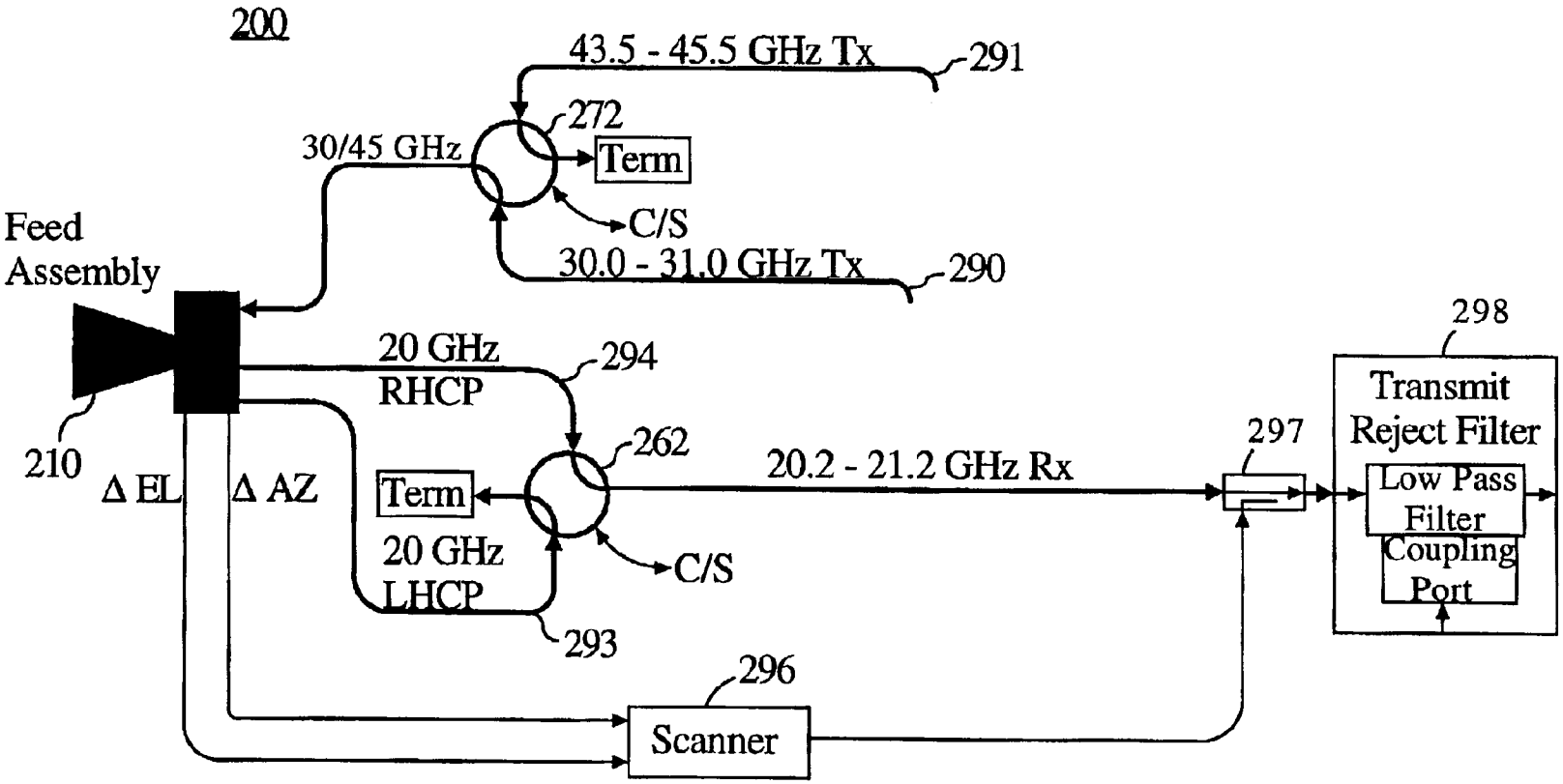
FIG. 3 is a block diagram of system including the receive and transmit system components of FIG. 2.

FIG. 3 showing a system including the feed system 200 of FIG. 2. The system 200 includes a scanner 296 coupled to the horn 210 (which acts as an amplitude and phase detector), a tracking coupler 297 coupled to the second baseball switch 262, and a transmit reject filter 298 that prevents transmit energy (signals 290 and 291) from entering the receive ports. These may be conventional components.

Figure 6B:
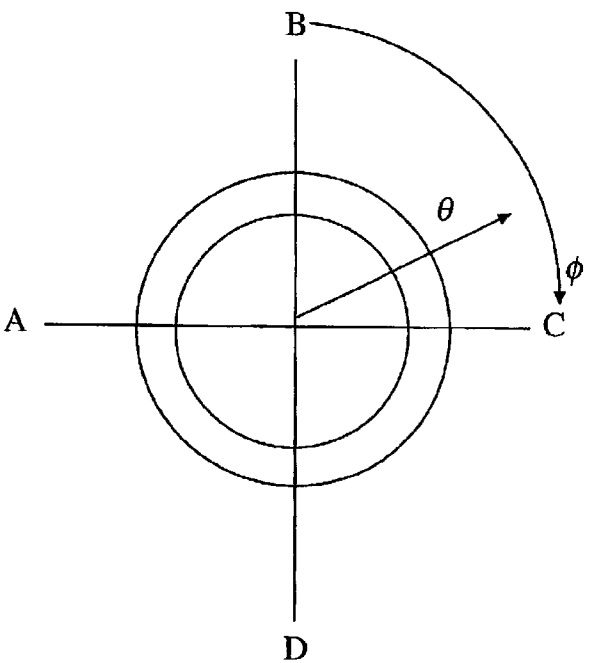
FIG. 6B is a graphical representation of the downlink subsystem of FIG. 1.
Figure 6A:
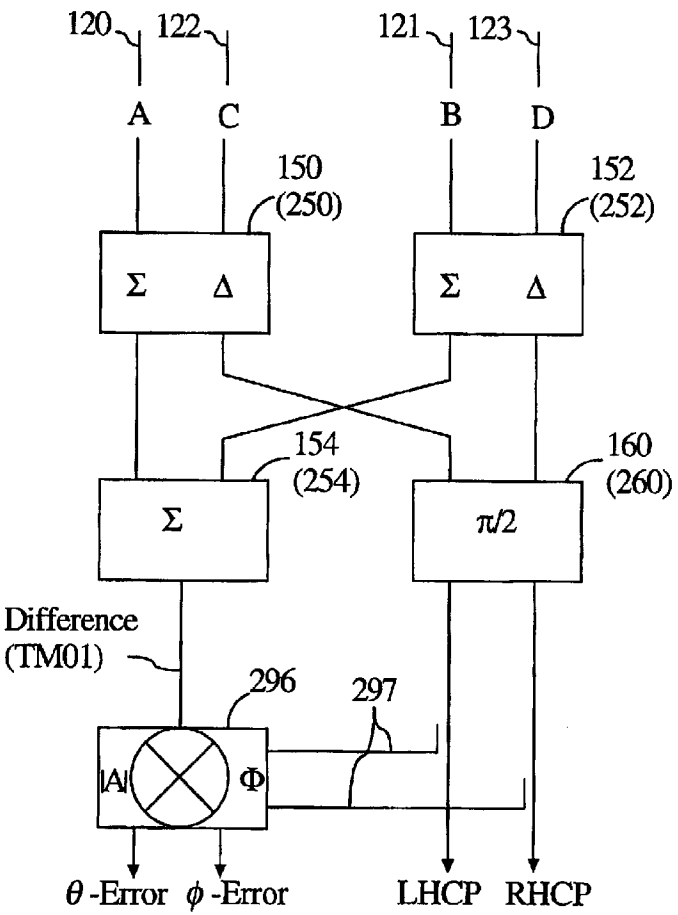
FIG. 6A is a functional block diagram of the downlink subsystem of FIG. 1.

FIG. 6A shows the downlink signal processing in system 100 (or system 200). The hybrid couplers in each of the two systems are the same as indicated by the reference numerals in parentheses and FIG. 6B illustrates the 20 GHz functions of the exemplary system.

Amplitude and phase detection circuits 296 respectively provide, in spherical coordinates of the boresight axis, a $\theta$ off-axis-deviation coordinate error signal, and a $\phi$ relative-position coordinate error signal, which are orthogonal to each other.

Table 1 is a truth table for the combiner network of FIG. 6A (and FIG. 7 as described below). Table 1 provides the relative phase of the launchers A, B, C and D.

TABLE 1

| | Sum TE11 | | |
|---|---|---|---|
| | LHCP | RHCP | Difference TM01 |
| A | 0 | 0 | 0 |
| B | $\pi/2$ | $3\pi/2$ | 0 |
| C | $\pi$ | $\pi$ | 0 |
| D | $3\pi/2$ | $\pi/2$ | 0 |

The polarization of the TM01-mode difference pattern is linear, with its axis normal to the axis of the feed. However, at a particular point off the feed axis, the phase of this linear polarization has a fixed relationship to the phase of the TE11-mode main beam. With the addition of a phase comparator 296 (coherent demodulator) to the feed to compare the phase at the coaxial TEM port to either (i.e., the co-polarizations) of the two orthogonal circularly polarized main beam ports, it is possible to determine the orientation of the angular pointing error off from boresight and to correct for it based on one singular measurement. The necessity for two or more consecutive measurements is thus obviated.

This system acts as a monopulse comparator with amplitude and phase detector. The third 0/180 hybrid coupler 154 (254) feeds straight into that phase and amplitude comparator (scanner) 296. Scanner 296 provides $|A|$, which is the amplitude and upper case phi ($\Phi$), which is the phase. Also, the Z axis of the spherical coordinates is the bore site, line of sight to the satellite, and $\theta$ is the deviation from bore site in any one direction. Lower case phi ($\phi$) is the circumferential deviation about the bore site. All that is needed to specify the tracking error is how far off the feed deviated from the bore site axis and which direction it deviated.

The information that comes out of phase and amplitude comparator 296 is the phase of the signal coming down and maps one-to-one to spatial degrees. The phase and the electrical degrees from zero to 360 on the calibrated system map into spatial orientation of feed from zero to 360 degrees with no ambiguity, no foldover, and no gaps. This is similar to monopulse operation. Tracking error can be determined with one pulse coming in. From the one pulse coming into this feed it is possible to determine the amplitude and the phase and thus to instantly determine in which direction ($\phi$) to correct the antenna, and by what angle ($\theta$).

The signal channel (the communication channel) is tapped. At any given time, the sum pattern that is coming on is tapped (taken down about 20 dB to 30 dB) to sample from LHCP signal 293 or RHCP signal 294, one at a time. A switch (not shown) in FIG. 6A allows the sample to be taken from the signal which is live.

The directional couplers 297 are used with the difference (TM01) signal coming down from the sigma block (third 0/180 degree coupler) 254. For amplitude, a reference signal is not needed. If zero, then there is no tracking error. If the signal has a certain amplitude, the correction can be determined with a calibration table, but the direction in which the correction is to be made is determined by the phase comparison of that difference (TM01) signal with the signal coming in from one of the directional couplers.

Figure 7:
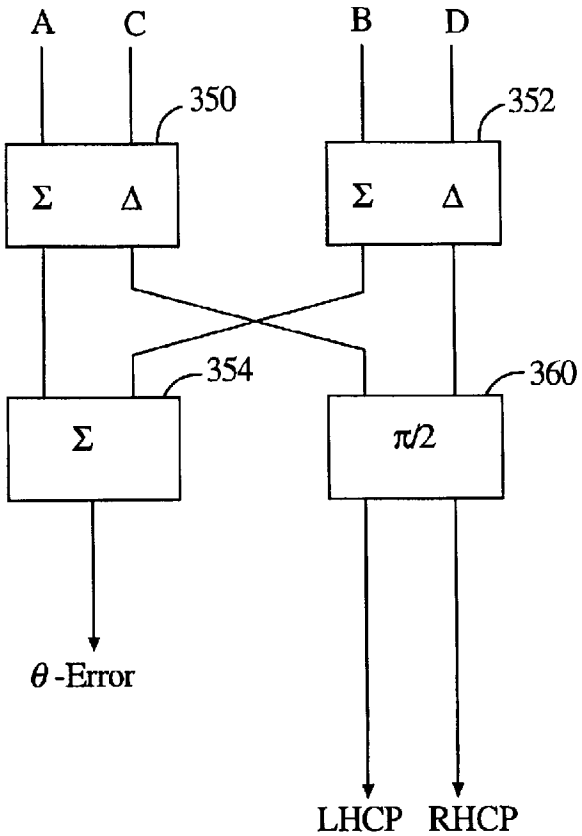
FIG. 7 is a functional block diagram of the subsystem shown in FIG. 6A.

FIG. 7 illustrates a method of using amplitude only to determine the tracking error (Amplitude Only Comparator). This is a con-scan on null technique, using the difference pattern amplitude only. For this mode, the amplitude and phase comparator 296 and the directional couplers 297 are not required. This technique can still provide frequency reuse with orthogonal polarizations.

The TM01-mode difference pattern is a circularly symmetric pattern with a null on the boresight. Therefore, azimuth and elevation difference patterns are not both provided. There is one difference signal, labeled $\theta$-error. This is no impediment to the design of the tracker because two arbitrary orthogonal planes $\alpha$ and $\beta$ can be selected. The difference pattern signal is sampled corresponding to a positional reference signal. The positional reference signal (with two orthogonal components PA and PB) can resolve the total difference pattern signal $\theta$-error into two of its components, DA and DB. Based on the change in consecutive reference signals PA and PB (either in the positive direction or the negative direction), the difference signals DA and DB can be resolved into $\alpha+$, $\alpha-$, $\beta+$ and $\beta-$ signals. Based on this sampling scheme, the tracker then processes the $\alpha+$, $\alpha-$, $\beta+$ and $\beta-$ signals to provide a corrective signal to keep the antenna on boresight. This function may be implemented in either hardware or software, With an amplitude-only comparator, it is possible to look at sequential signals and after a few consecutive tries, determine whether the error is getting worse or better. The system can then make a judgment as to the correct direction in which to make the correction. In other words, if the error gets worse after moving the antenna in a first direction, the antenna is moved in the opposite direction. This is similar to an adaptive process. This may be a desirable technique for tracking targets such as satellites, which do not change direction quickly, because it is a less expensive solution. When the maximum signal is provided on the LHCP and RHCP, the minimum signal is provided from the Sigma block 354 (or 154 or 254). The difference pattern has a well defined null and high slope near the null. Thus, a slight tracking error causes a large change in the difference (TM01) signal from block 354. This is more pronounced than the slope of the sum pattern for small deviations.

One of ordinary skill will recognize that the amplitude only comparator technique is not a monopulse method and a series of measurements is required. Thus, the technique is more appropriate for any situation in which it is desired to make a correction based on a single measurement of the tracking error.

Another aspect of the exemplary system is the provision of a method for conducting signals. First and second transmit signals 290, 291 are provided to a rear end of a single horn 210 for transmission. The first and second transmit signals 290, 291 have respectively different first and second frequencies such as, for example, 30 and 44 GHz. Downlink signals are provided with the single horn 210. The downlink signals have a third frequency different from either of the first and second frequencies, such as 20 GHz. The downlink signals are fed through four evenly spaced openings in the sides of the single horn 110. A sum output signal and difference output signal are formed from the downlink signals for communications and tracking. The exemplary method uses a TM01 mode tracking feed.

Another advantageous feature is the method for fabricating an antenna feed by the steps of connecting a transducer 180 to a rear 110*r* of a horn 110 having a corrugated section 110*c*, cutting four openings 110*p* in a side wall of a single corrugation of the corrugated section, providing a matching transformer 114 at each of the four openings to form four coupling sections, and connecting the four coupling sections of the horn to a combiner network 101 via waveguides.

A tracking mode feed as described above is capable of simultaneously producing a sum and a difference signal. The exemplary difference mode is capable of delivering an error signal proportionate to the deviation (theta) off axis from boresight. The exemplary difference mode is capable of producing an error signal in relation to the relative position (phi) around boresight.

The feed launcher ports around the periphery of the feed are phased to match the circumferential field distribution of the particular mode. The launching of the feed are such that it suppresses all other lower or higher order modes which would obscure the difference pattern null and create excessive cross polarized components in the sum pattern (e.g., the TE21 mode). The TM01 mode feed attains these three characteristics.

The TM01 mode has total radial symmetry. It can be launched by as few as two opposite launching ports just like the TE11 sum pattern mode. Four launching points are provided (two for each orthogonal polarization) to create circular polarization for the sum pattern. Unlike the TE21 mode, the TM01 mode difference pattern cannot be made circularly polarized.

The TM01 mode tracking feed employs a much simpler turnstile launcher by appropriately choosing a location along the feed horn where the diameter is narrower than the cutoff diameter of all the higher order modes including the TE21 mode. There are no interfering lower orders modes, but just the TE11 fundamental mode.

The system described above has many advantages. For example, the TM01 tracking mode launcher is simpler and takes less space than the TE21 tracking mode feed. Incorporating the launcher ports within the corrugated horn makes a much shorter feed. The exemplary receive port supports 20 GHz band downlink of two different satellite systems. The axial port of the horn is freed up to support the 30 GHz and 44 GHz uplink bands. The use of one single feed operating with two different satellites (different frequencies and/or polarizations) makes the tactical deployment of the SatCom terminal much easier because there is no need to interchange parts. The exemplary embodiment improves bandwidth and cross-polarization performance by utilizing variable depth and variable width corrugations. The launching ports are positioned at a location (which may be up or down the neck of the horn) where all higher order modes are suppressed. The example includes into-the-corrugation launchers with mode filters that suppress wider bandwidths (30 GHz and 44 GHz). Although the exemplary OMT's 180 (or 280) are configured for use at 30 and 44 GHz, this is only an example of a broadband OMT type that can be used to service two satellites having the same downlink communications and tracking frequency band, but two specific uplink frequencies. One of ordinary skill can readily design an OMT of appropriate bandwidth for any given set of transmit frequencies, which may correspond to two different satellites or one satellite equipped to handle uplink signals in two different frequency bands.

Although 30/44 GHz diplexers 273 may be used, diplexers may readily be designed corresponding to any frequencies of interest. Appropriate mode filters are selected for whatever transmit frequencies are selected.

Figure 10A:
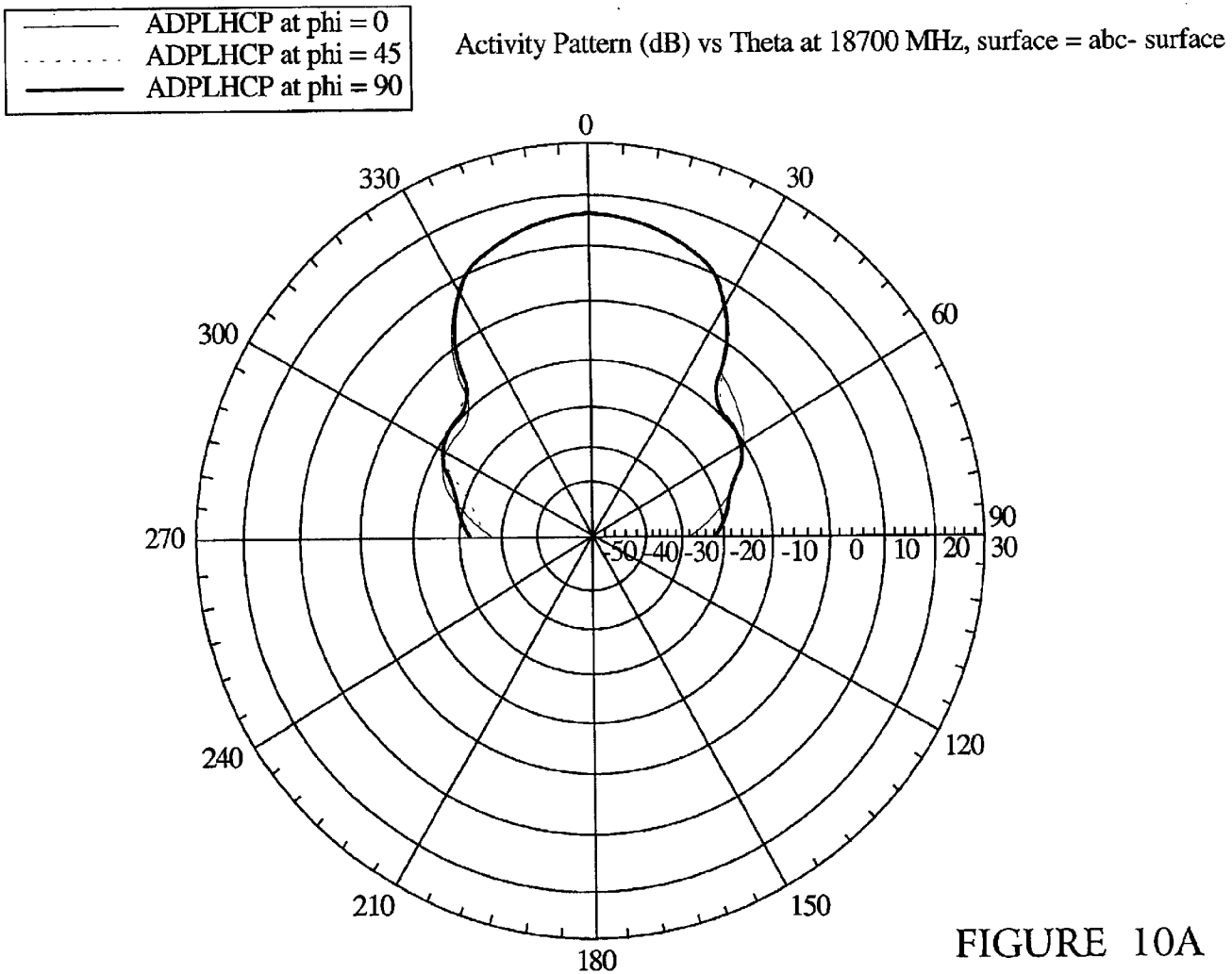
FIGS. 10A and 10B show respectively the primary co-polarization and the primary cross-polarization sum patterns of the feed in the 20 GHz band.
Figure 10B:
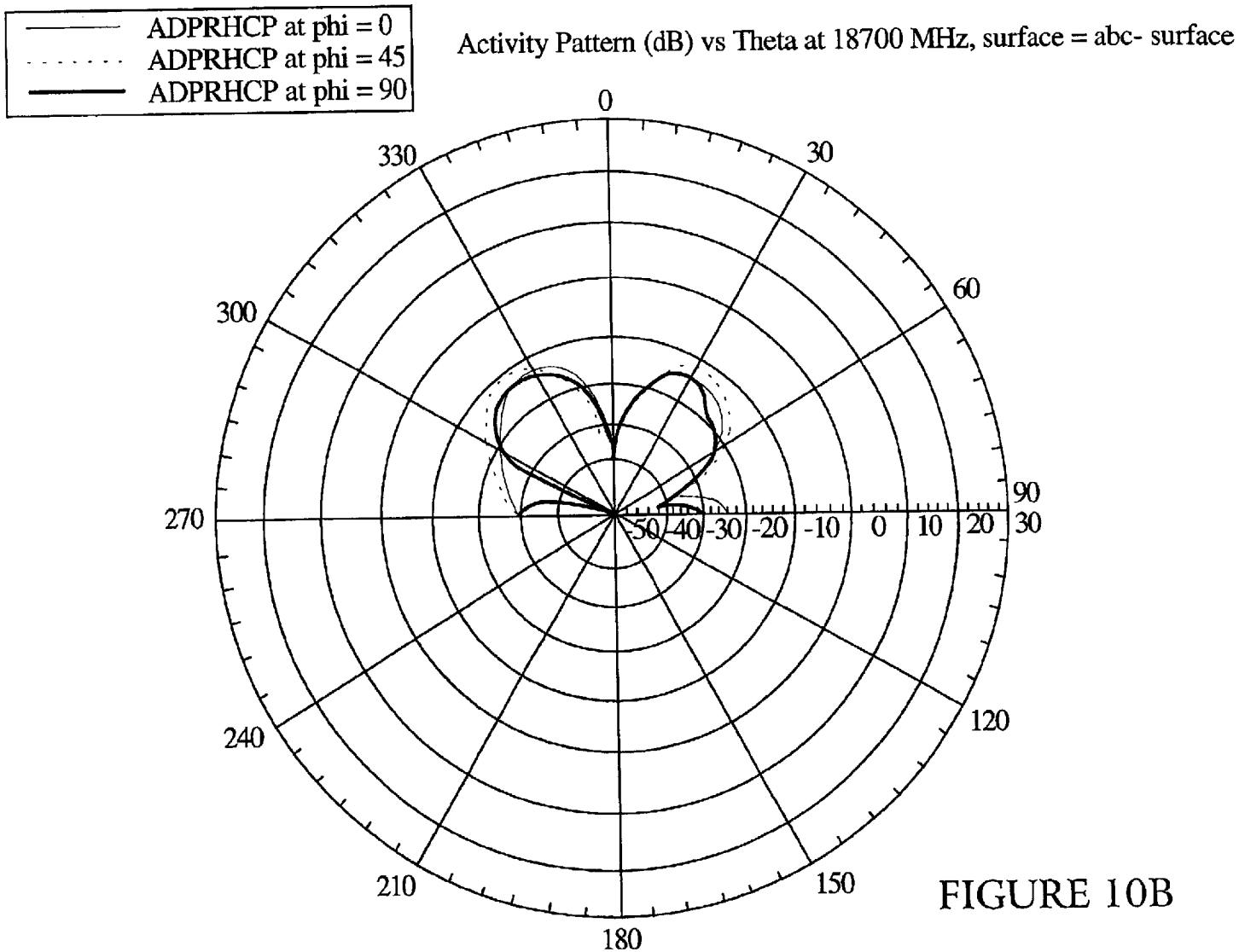

FIGS. 10A–15 show performance of the exemplary feed design described above, with FIG. 10A showing the primary co-polarization sum patterns and FIG. 10B shows the primary cross-polarization sum pattern of the feed in the 20 GHz band. Both FIGS. 10A and 10B show the patterns for $\phi$=0, 45 and 90 degrees. This is three overlays of the same horn 110 looking at three different planes, there is pattern symmetry. The three patterns are almost identical, which is very desirable.

FIG. 10B illustrates the cross polarization component, which is desirably low compared to the pattern of FIG. 10A. The patterns are relative to each other with respect to power levels, so there is a cross polarization isolation of 30 dB or more between the co-polarization pattern of FIG. 10A and the cross polarization pattern of FIG. 10B. This means energy is not being wasted in the opposite sense, or in the opposite polarization.

Figure 11A:
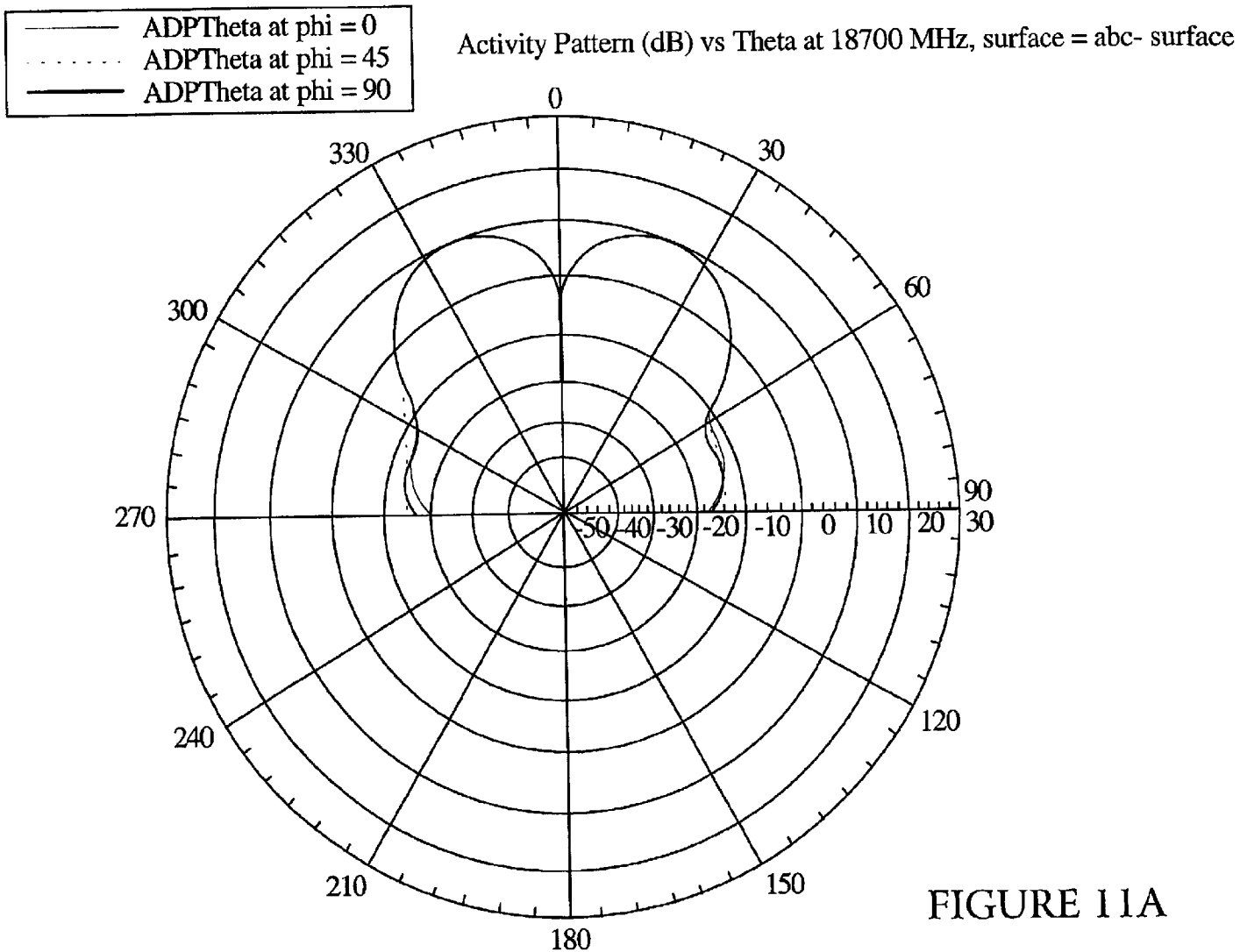
FIGS. 11A and 11B show respectively the primary difference patterns for co-polarization and cross-polarization for the 20 GHz feed.
Figure 11B:
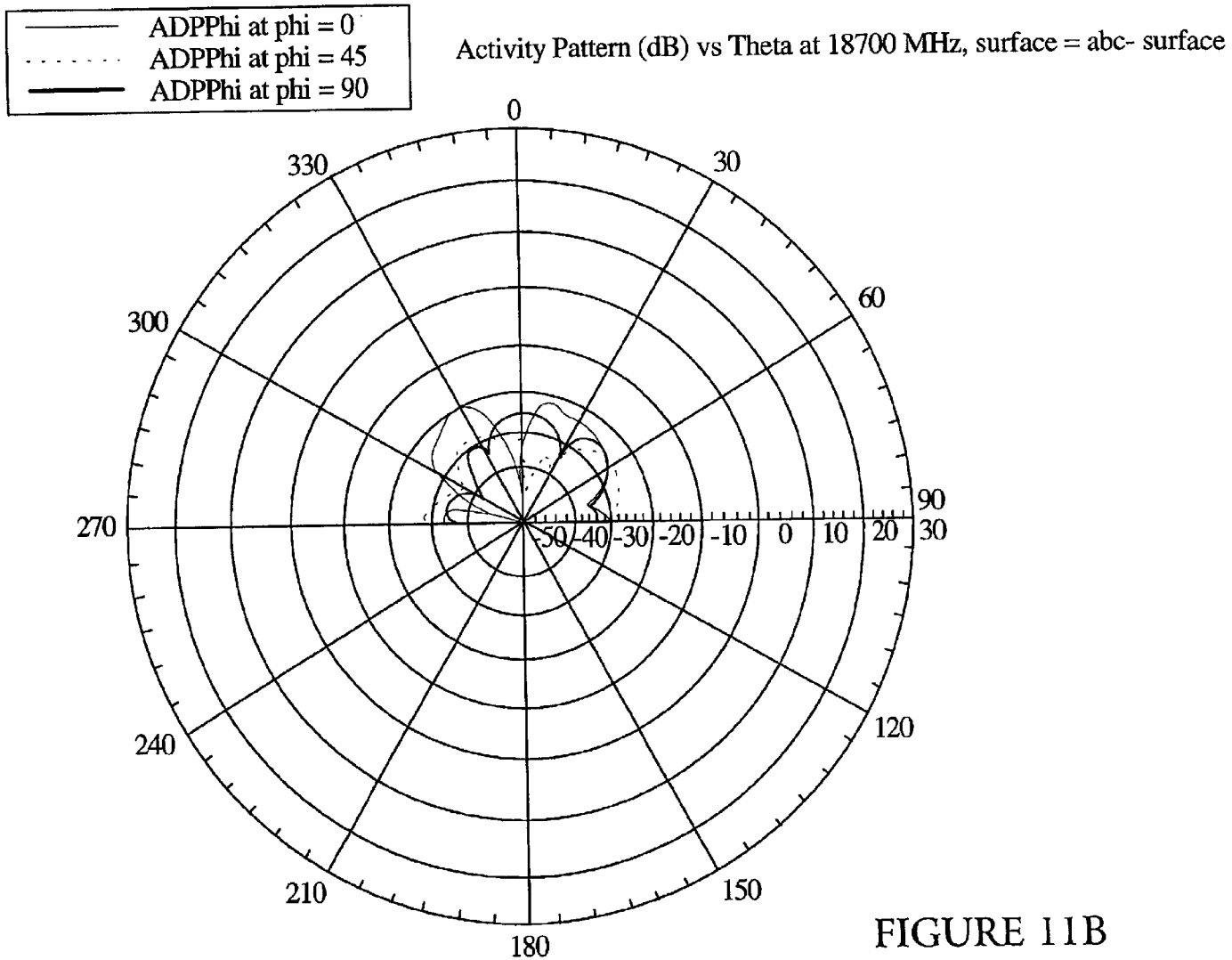
Figure 12:
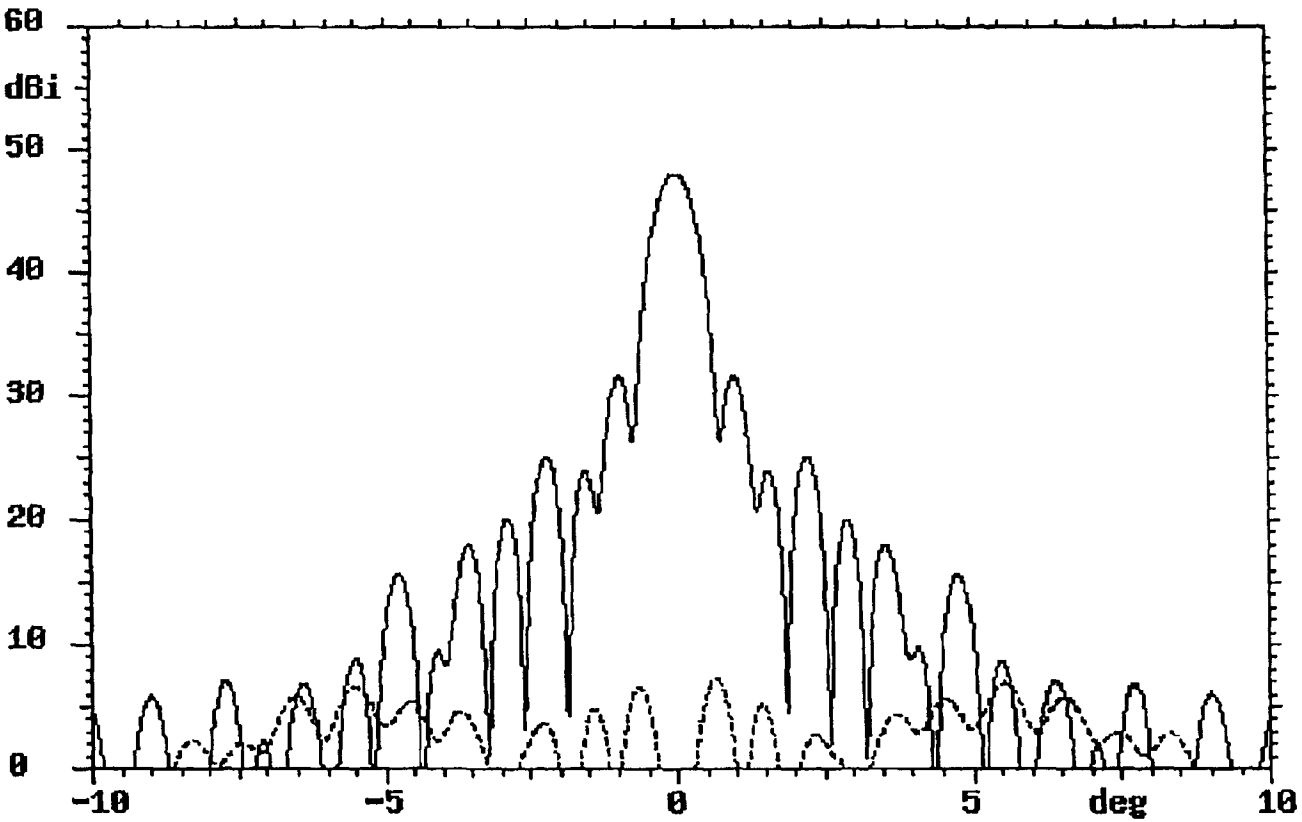
FIG. 12 is a graphical representation of the sum patterns for the receive channel at 20.7 GHz

FIGS. 11A and 11B show the primary difference patterns, for co-polarization and cross-polarization, respectively, for the 20 GHz feed, for $\phi$=0, 45 and 90 degrees. Again, the good null definition on the bore site is desirable. The symmetry on the left and right hand side of the pattern is also advantageous. There is symmetry across the aperture, including balanced left and right lobes, a deep null and good cross polarization suppression FIG. 12 illustrates the sum patterns for the receive channel at 20.7 GHz, including co-polarization (solid line) and cross-polarization (dashed line).

Figure 13:
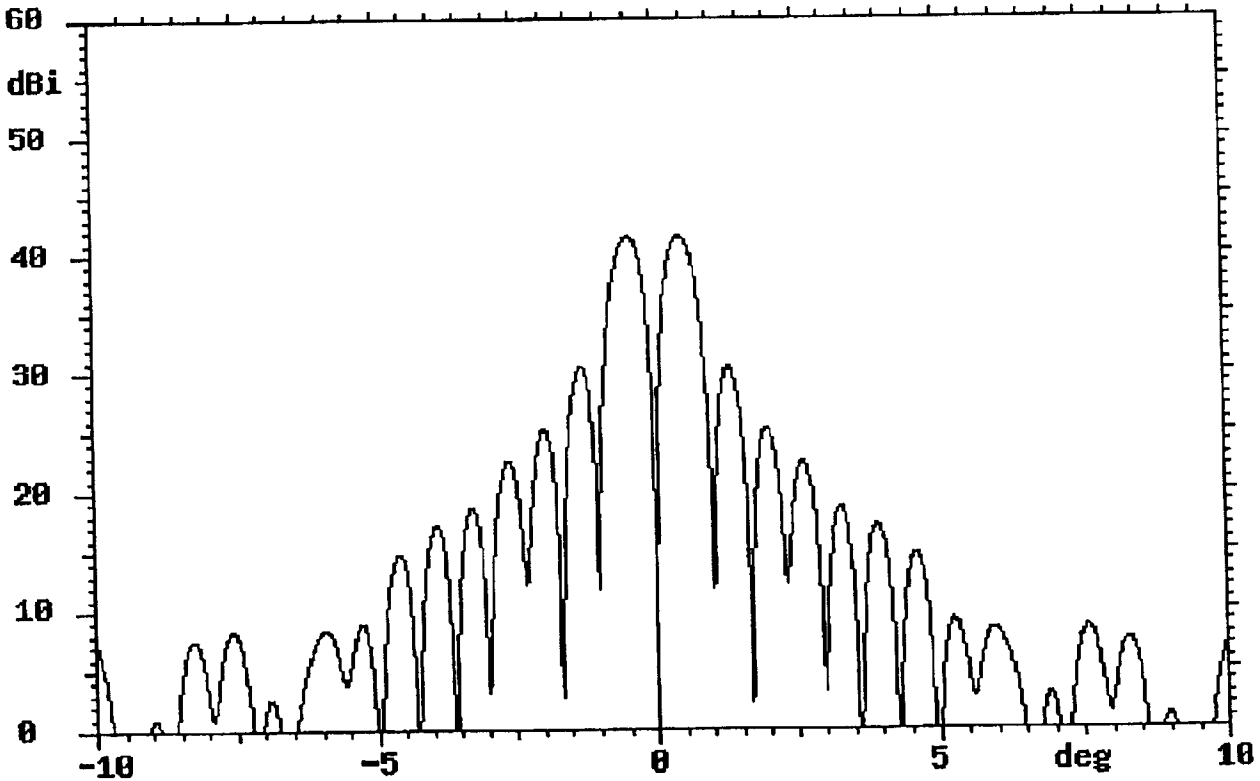
FIG. 13 is a graphical representation of the tracking difference patterns for the receive channel at 20.7 GHz

FIG. 13 illustrates the tracking difference patterns for the receive channel at 20.7 GHz, including co-polarization (solid line) and cross-polarization (dashed line). As mentioned above with reference to FIG. 7, there is good null definition for the difference pattern on the bore site, which makes this desirable for the amplitude-only comparator tracking mode.

Figure 14:
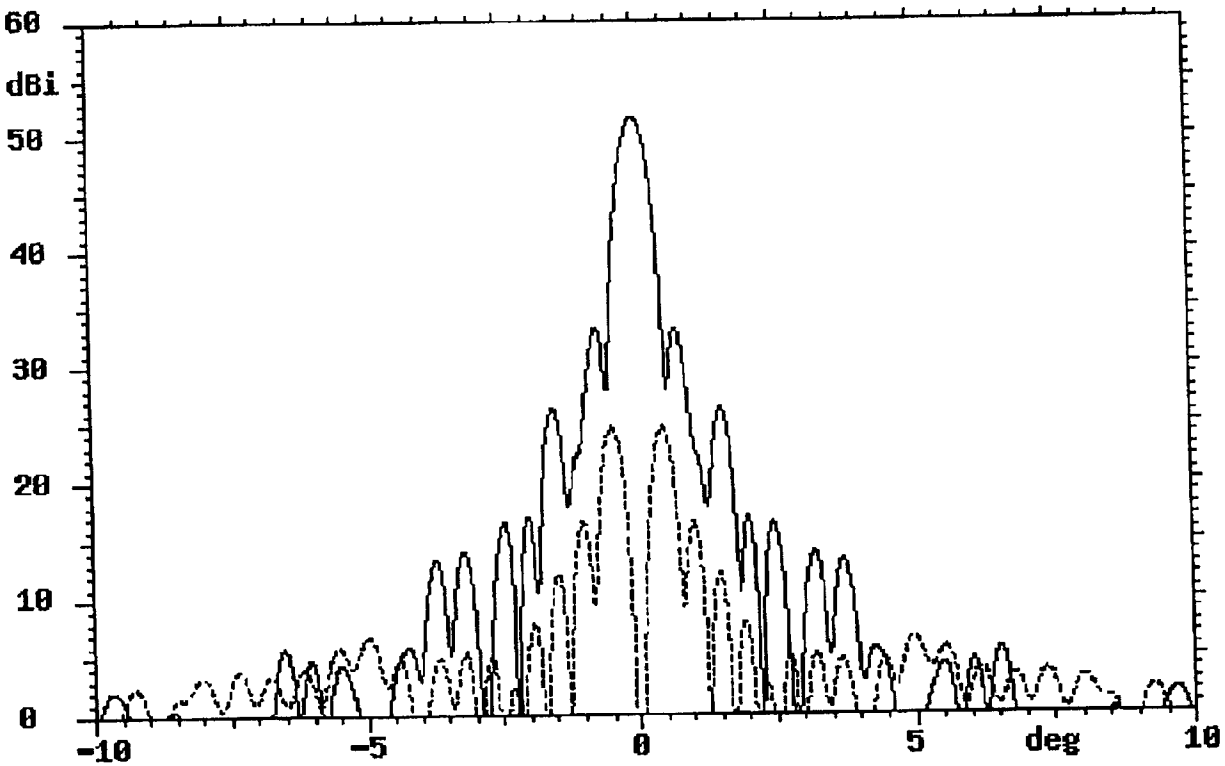
FIG. 14 is a graphical representation of the sum patterns for the transmit channel at 30.5 GHz.

FIG. 14 shows the sum patterns for the transmit channel at 30.5 GHz, including co-polarization (solid line) and cross-polarization (dashed line).

Figure 15:
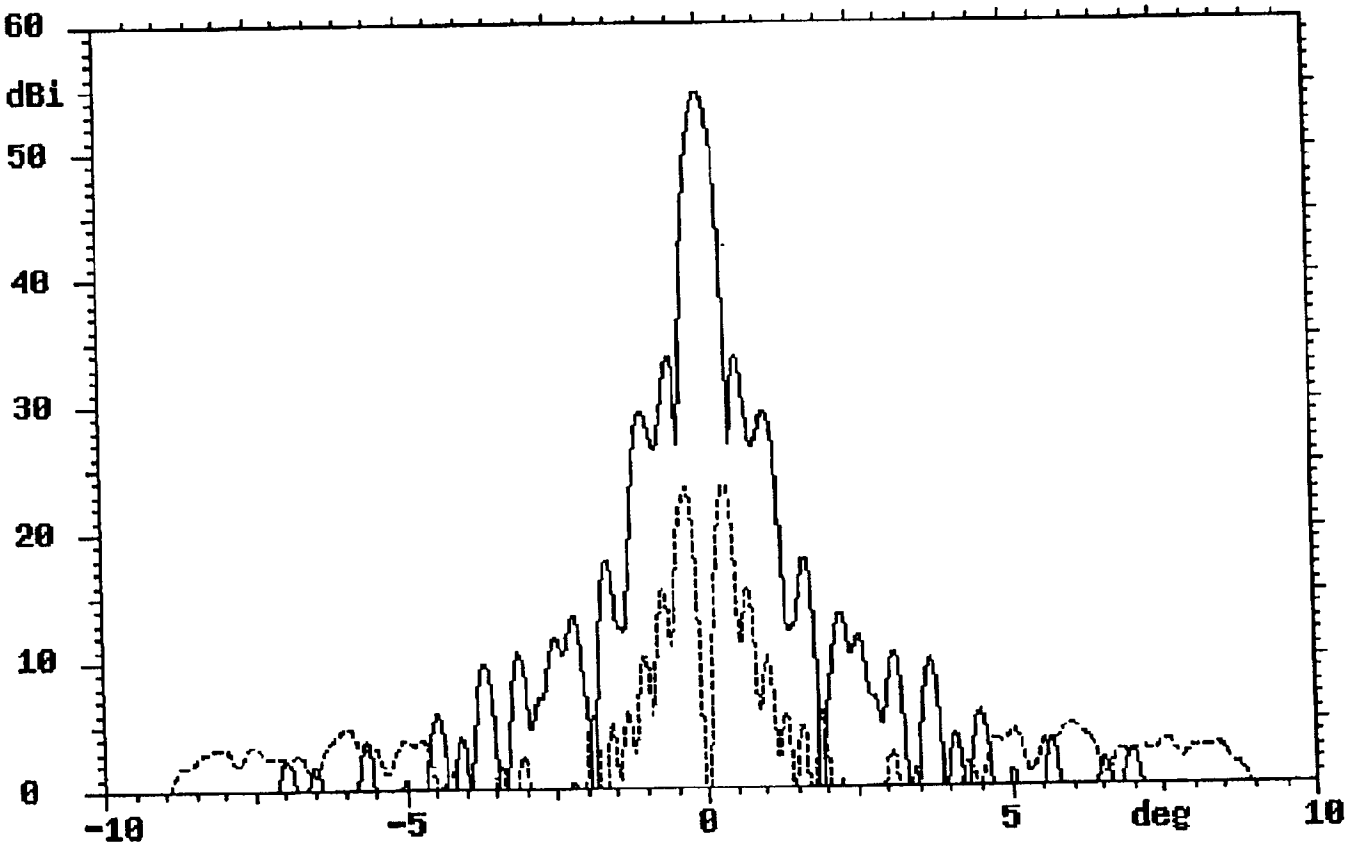
FIG. 15 is a graphical representation of the sum patterns for the transmit channel at 44.0 GHz.

FIG. 15 shows the sum patterns for the transmit channel at 44.0 GHz, including co-polarization (solid line) and cross-polarization (dashed line).

Although the invention has been described in terms of exemplary embodiments, it is not limited thereto. Rather, the appended claim should be construed broadly, to include other variants and embodiments of the invention, which may be made by those skilled in the art without departing from the scope and range of equivalents of the invention.

What is claimed is:

1. An antenna feed system, comprising:

a single horn having corrugations and four evenly spaced waveguide ports in a single one of said corrugations;

a combiner network that receives signals at approximately 20 GHz from the four waveguide ports and provides sum and difference output signals; and a transducer that provides transmit signals at approximately 30 GHz and at approximately 44 GHz to a rear end of the single horn.

2. The system of claim 1 wherein said combiner network includes:

first and second 0/180 degree hybrid couplers, each coupled to a respective two of said four waveguide ports, the first 0/180 degree hybrid coupler providing an elevation difference output signal, and said second 0/180 degree hybrid coupler providing an azimuth difference output signal; and a 0/90 degree hybrid coupler having inputs coupled to difference ()) outputs of the first and second 0/180 degree hybrid couplers to provide said sum output signal.

3. The system of claim 2, wherein the combiner network further comprises a third 0/180 degree hybrid coupler coupled to sum (E) output terminals of said first and second 0/180 degree hybrid couplers to provide said difference output signal.

4. The system of claim 2, further comprising:

a first baseball switch for selecting one of the 30 and 44 GHz signals for transmission; and a second baseball switch coupled to outputs of the 0/90 degree hybrid coupler for selecting a polarization of the 20 GHz signal.

5. The system of claim 4, further comprising a scanner coupled to said horn, a tracking coupler coupled to said second baseball switch, and a transmit reject filter.

6. The system of claim 1 wherein the tracking mode feed is Tm01.

7. An antenna feed system, comprising:

a single horn having a plurality of waveguide ports coupled to the sides thereof;

a transducer for providing first and second transmit signals to the rear end of said single horn at different first and second frequencies; and a combiner network that receives signals from said waveguide ports at a third frequency different from said first and second frequencies and provides sum and difference output signals.

8. The system of claim 7, wherein said single horn has a corrugated feed portion with an opening for each of said waveguide ports in one of the corrugations.

9. The system of claim 7, wherein said single horn has four waveguide ports evenly spaced about the sides thereof.

10. The system of claim 9, further comprising a pair of 0/180 degree hybrid couplers;

wherein said wave guide ports are divided into pairs each having a first port and a second port positioned 180 degrees from the first port, each of said 0/180 degree hybrid couplers being connected to one of said pairs of waveguide ports.

11. The system of claim 10, wherein a first one of said 0/180 degree hybrid couplers provides an elevation difference signal, and a second one of said 0/180 degree hybrid couplers provides an azimuth difference signal, said azimuth and elevation signals being suitable for tracking; and wherein the system further comprises a third 0/180 degree hybrid coupler, the output signals from said first and second 0/180 degree hybrid couplers being connected to an input terminal of said third 0/180 degree hybrid coupler.

12. The system of claim 11, wherein said third 0/180 degree coupler provides a difference signal for tracking.

13. The system of claim 11, further comprising amplitude and phase detection circuits respectively providing, in spherical coordinates of the boresight axis, a 2 off-axis-deviation coordinate error signal, and a N relative-position coordinate error signal, which are orthogonal to each other.

14. The system of claim 10, further comprising a 0/90 degree hybrid coupler, said 0/180 degree hybrid couplers being operatively connected to said 0/90 degree hybrid coupler.

15. The system of claim 14, wherein said 0/90 degree hybrid coupler provides said sum signal for communications.

16. The system of claim 14, further comprising a baseball switch coupled to outputs of the 0/90 degree hybrid to control the polarization of the sum signal.

17. The system of claim 9, further comprising a respective matching transformer at each of said four wave guide ports.

18. The system of claim 7, further comprising a baseball switch coupled to said transducer for selecting one of said first and second transmit signals.

19. The system of claim 7, wherein said first frequency is approximately 30 GHz, said second frequency is approximately 44 GHz, and said third frequency is approximately 20 GHz.

20. The system of claim 7, including a TM01 tracking mode feed.

21. A method for conducting signals comprising the steps of:

(a) providing at least first and second transmit signals of different frequencies to the rear end of the same horn for transmission;

(b) receiving a downlink signals with the horn at a frequency different from the frequency of the transmit signals;

(c) feeding the downlink signal through the sides of the horn; and (d) forming sum and difference output signals from the downlink signals for communications and tracking.

22. The method of claim 21, wherein the fed is a TM01 mode tracking feed.

23. The method of claim 21, wherein the first frequency is approximately 30 GHz, the second frequency is approximately 44 GHz, and the third frequency is approximately 20 GHz.

24. The method of claim 21, wherein the downlink signals are fed to the horn through four evenly spaced ports on the sides thereof.

25. The method of claim 21, wherein four signals are provided to the horn, the polarization of two of the signals being orthogonal to the other two of the signals.

26. A method for conducting signals, comprising the steps of:

(a) providing at least two transmit signals of different frequencies to a single horn for transmission;

(b) receiving downlink signals with the horn at a frequency different from the transmit frequencies; and (c) forming sum and difference output signals from the downlink signals for communications and tracking.

* * * * *